US007032646B2

(12) United States Patent
Yamasaki et al.

(10) Patent No.: US 7,032,646 B2
(45) Date of Patent: Apr. 25, 2006

(54) MOLD FOR CONTINUOUS CASTING

(75) Inventors: Norimasa Yamasaki, Futtsu (JP); Masahiro Tani, Kitakyushu (JP); Keiji Tsunenari, Futtsu (JP)

(73) Assignee: Nippon Steel Corporation, Tokyo (JP)

( * ) Notice: Subject to any disclaimer, the term of this patent is extended or adjusted under 35 U.S.C. 154(b) by 0 days.

(21) Appl. No.: 10/513,565

(22) PCT Filed: Mar. 3, 2004

(86) PCT No.: PCT/JP2004/002614

§ 371 (c)(1),
(2), (4) Date: Nov. 3, 2004

(87) PCT Pub. No.: WO2004/078380

PCT Pub. Date: Sep. 16, 2004

(65) Prior Publication Data

US 2005/0161191 A1 Jul. 28, 2005

(30) Foreign Application Priority Data

Mar. 3, 2003 (JP) ..... 2003-055748

(51) Int. Cl.
*B22D 11/00* (2006.01)
*B22D 27/02* (2006.01)

(52) U.S. Cl. ..... 164/502; 164/466

(58) Field of Classification Search ..... 164/466–468, 164/502–504

See application file for complete search history.

(56) References Cited

FOREIGN PATENT DOCUMENTS

| | | | |
|---|---|---|---|
| JP | 52-32824 | | 3/1977 |
| JP | 4-294844 | * | 10/1992 |
| JP | 5-15949 | | 1/1993 |
| JP | 5-57592 | | 3/1996 |
| JP | 8-90165 | | 4/1996 |
| JP | 2000-176609 | * | 6/2000 |
| JP | 2000-246397 | | 9/2000 |

* cited by examiner

*Primary Examiner*—Kuang Y. Lin
(74) *Attorney, Agent, or Firm*—Kenyon & Kenyon LLP

(57) ABSTRACT

The present invention: provides a mold for continuous casting that makes it possible to prevent insulation from deteriorating when continuous casting is carried out with electromagnetic force applied to and produce castings of good quality for a long period of time; and is a mold for continuous casting, said mold for continuous casting being equipped with a magnet coil that imposes electromagnetic force on molten metal in the direction perpendicular to the inner wall of said mold in the vicinity of the meniscus of said molten metal in said mold for continuous casting, a pair of the first sets each of which is formed by combining a first cooling copper plate with a first back plate, and another pair of the second sets each of which is formed by combining a second cooling copper plate with a second back plate, and being configured so that a pair of said first sets each of which is composed of a first cooling copper plate and a first back plate are movably interposed between a pair of said second sets each of which is composed of a second cooling copper plate and a second back plates, characterized in that said first cooling copper plates of a pair of said first sets are interposed between said second cooling copper plate of a pair of said second sets in the state of being not electrically insulated from, but being electrically connected with, each other.

13 Claims, 10 Drawing Sheets

1
5
5
5
5
a
c
b
CASTING DIRECTION

MOLD FOR CONTINUOUS CASTING

TECHNICAL FIELD

The present invention relates to a mold for continuous casting, the mold being variable in the width of a casting and being installed in a continuous caster that is equipped with a magnet coil and stably imposes an electromagnetic force on the molten metal in the mold.

BACKGROUND ART

Among the technologies for continuously casting molten metal, a technology that makes use of electromagnetic force during casting has been developed in order to attain stabilization of the bath level of the molten metal, a smooth surface of a continuously cast casting and an increase in casting speed.

For example, Japanese Unexamined Patent Publication No. S52-32824 discloses a method that is aimed at improving the surface appearance of a casting by, as shown in FIG. 11: supplying alternating current to an energizing coil 35 disposed so as to surround a mold 31 and insulated with refractories; curving the meniscus 33 of molten metal 32 and by so doing accelerating the inflow of powder 34; and reducing a contact pressure between the mold and the casting at the time of primary solidification. However, the problem of this method has been that induction current is induced in cooling copper plates composing a mold by an alternating magnetic field imposed by a magnet coil and, due to the surface effect, the magnetic field to be imposed on molten metal in the mold is attenuated.

Further, as a means of restraining the attenuation of a magnetic field in a mold for continuous casting and further enhancing the electromagnetic effect, Japanese Unexamined Patent Publication No. H05-15949 discloses a continuous caster for metal casting that is equipped with a metal mold 31 with an internal cooling construction and a magnet coil 35 that circles the mold and conducts a high frequency current, as shown in FIG. 10. In this continuous caster, the mold 31 has either (a), at the upper part of the mold, segments 37 with an internal cooling construction that are divided from each other by plural slits 36 which do not reach the top end of the mold and are parallel to the casting direction, or (b), at the upper part of the mold, segments 37 with an internal cooling construction that are divided from each other by plural slits 36 parallel to the casting direction and plural beams that connect the segments. A magnet coil 35 is disposed so as to circle the segments. Here, molten metal is supplied into the mold through an immersion nozzle 38.

However, with a mold having such slits, as the mold cannot be reinforced with back plates or the like, the rigidity of the mold is insufficient, the mold tends to be deformed thermally, and thus the mold has seldom been applied to a casting having a large section, such as a slab. In order to solve such problems, Japanese Unexamined Patent Publication No. 2000-246397 discloses a continuous caster for casting molten metal wherein an electromagnetic force is imposed in the direction perpendicular to the mold wall on the molten metal in the vicinity of a primarily solidified portion at a meniscus in a mold for continuous casting as shown in FIG. 9.

This mold 31 for continuous casting comprises: a magnet coil 35 that is disposed around the circumferential surface of the mold and conducts alternating current; a pair of the first sets each of which is composed of a first cooling copper plate 39 and a first back plate 41 made of nonmagnetic stainless steel; a pair of the second sets each of which is composed of a second cooling copper plate 40 and a second back plate 42 made of nonmagnetic stainless steel; and plural divided cooling parts including insulators 46. Each of the first cooling copper plates 39 and the second cooling copper plates 40 has at least one groove on the surface opposite the casting surface 49 and is airtightly fixed on the grooved surface to the relevant first back plate 41 or second back plate 42 with fastening bolts 44. Here, sealers 47 are inserted between each of the cooling copper plates and the relevant back plate. In this way, a coolant path 43 is formed by the groove(s) of each cooling copper plate and the relevant back plate.

Further, each of the first cooling copper plates 39 is electrically insulated from the adjacent second cooling copper plates 40 by the insulators 46 and also each of the first back plates 41 is fastened to the adjacent second back plates 42 with insulated fastening bolts 45 in an electrically insulated manner. This method has the advantages of being not only able to reduce the loss of electromagnetic force but also being able to secure machining accuracy and assembling accuracy by dividing the full circumferential length of a mold into units.

However, in the case of a mold which is configured so that the first cooling copper plates of the narrower side are interposed between the second cooling copper plates of the wider side and an insulator is placed at each of the mating faces 48 of each of the first cooling copper plates and the adjacent second cooling copper plates, when the first cooling copper plates slide and the width of a casting is changed, the insulator may be damaged and fall off due to the friction or the intrusion of foreign materials at the mating faces. Therefore, though it is possible to maintain the insulation at the early stage of casting, it is possible that, when the operations of width change and the like are repeated, insulation performance deteriorates and a desired electromagnetic force cannot be imposed.

In a commonly used width-variable mold, insulators made of Teflon (a registered trademark) or the like are sometimes interposed between copper plates to prevent scratches. However, the object is other than insulation and the copper plates partially touch each other electrically. Since the insulation resistance of the insulators is insufficient at these portions, a desired electromagnetic force is hardly imposed.

DISCLOSURE OF THE INVENTION

The object of the present invention is to provide a mold for continuous casting, the mold being variable in the width of a casting, being installed in a continuous caster that is equipped with a magnet coil and that stably imposes an electromagnetic force on molten metal in the mold, and being able to produce castings of good quality over a long service life.

The present invention, in view of the above problems, prevents insulation performance in the circumferential direction of a mold for continuous casting from deteriorating when movable cooling copper plates slide and the width of the casting is changed, by electrically connecting movable cooling copper plates with cooling copper plates that interpose the movable cooling copper plates. The gist of the present invention is as follows:

(1) A mold for continuous casting, said mold for continuous casting: being equipped with a magnet coil that imposes electromagnetic force on molten metal in the direction perpendicular to the inner wall of said mold in the vicinity of the meniscus of said molten metal in said mold for continuous casting, a pair of the first sets each of which is formed by combining a first cooling copper plate with a first back plate and another pair of the second sets each of which is formed by combining a second cooling copper plate with a second back plate; and being configured so that a pair of said first sets each of which is composed of a first cooling copper plate and a first back plate are movably interposed between a pair of said second sets each of which is composed of a second cooling copper plate and a second back plate, characterized in that said first cooling copper plates of a pair of said first sets are interposed between said second cooling copper plates of a pair of said second sets in the state of not being electrically insulated from but being electrically connected with each other.

(2) A mold for continuous casting according to the item (1), characterized by: dividing either or both of said first cooling copper plates of a pair of said first sets and said second cooling copper plates of a pair of said second sets so that each of the relevant cooling copper plates is divided into two or more parts so as to be separated in the plate width direction; and making the adjacent divided parts touch each other in an electrically insulated manner.

(3) A mold for continuous casting according to the item (2), characterized in that the back plate combined with each of said cooling copper plates, each of which is divided into two or more parts, does not touch or is electrically insulated from the relevant cooling copper plate divided into two or more parts.

(4) A mold for continuous casting according to the item (2) or (3), characterized by dividing said relevant cooling copper plates along the direction parallel to the casting direction.

(5) A mold for continuous casting according to the item (2) or (3), characterized by dividing said relevant cooling copper plates at an angle of 5° or less to the casting direction.

(6) A mold for continuous casting according to the item (2) or (3), characterized by inserting an insulator 10 μm to 1 mm in thickness between adjacent two divided parts of each of said relevant cooling copper plates.

(7) A mold for continuous casting according to the item (2) or (3), characterized by inserting an electrically insulative ceramic plate or an insulator comprising a ceramic, formed by coating, between two adjacent divided parts of each of said relevant cooling copper plates.

(8) A mold for continuous casting according to the item (2) or (3), characterized by inserting an insulator comprising any one or more of an oxidic ceramic, a mica plate, a ceramic fiber compact and a resin between two adjacent divided parts of each of said relevant cooling copper plates.

(9) A mold for continuous casting according to the item (3), characterized by inserting an electrically insulative ceramic plate or an insulator comprising a ceramic, formed by coating, between each of said divided cooling copper plates and the back plate combined therewith.

(10) A mold for continuous casting according to the item (3), characterized by inserting an insulator comprising any one or more of an oxidic ceramic, a mica plate, a ceramic fiber compact and a resin between each of said divided cooling copper plates and the back plate combined therewith.

(11) A mold for continuous casting according to any one of the items (1) to (3), characterized in that said first back plates are made of any one of stainless steel, copper and a copper alloy.

(12) A mold for continuous casting according to any one of the items (1) to (3), characterized in that said first back plates of a pair of said first sets do not touch or are electrically insulated from said second cooling copper plates and said second back plates of a pair of said second sets.

(13) A mold for continuous casting according to any one of the items (1) to (3), characterized in that said second back plates of a pair of said second sets do not touch or are electrically insulated from each other.

(14) A mold for continuous casting according to the item (2) or (3), characterized in that each of said cooling copper plates to be divided is not fully but partially divided so that only a part of the full length from the top end to the bottom end of said cooling copper plate in the casting direction may be divided.

BRIEF DESCRIPTION OF THE DRAWINGS

FIG. 7(*b*) is a schematic illustration showing an example of the way in which a cooling copper plate is divided from the top end to an intermediate portion thereof along the casting direction while the bottom end portion b thereof remains undivided.

FIG. 7(*c*) is a schematic illustration showing an example of the way in which a cooling copper plate is divided from an intermediate portion to the bottom end thereof along the casting direction while the top end portion a thereof remains undivided.

FIG. 7(*d*) is a schematic illustration showing an example of the way in which a cooling copper plate is divided at an intermediate portion thereof along the casting direction while the top end a and bottom end b portions thereof remain undivided.

BEST MODE FOR CARRYING OUT THE INVENTION

Figure 1:
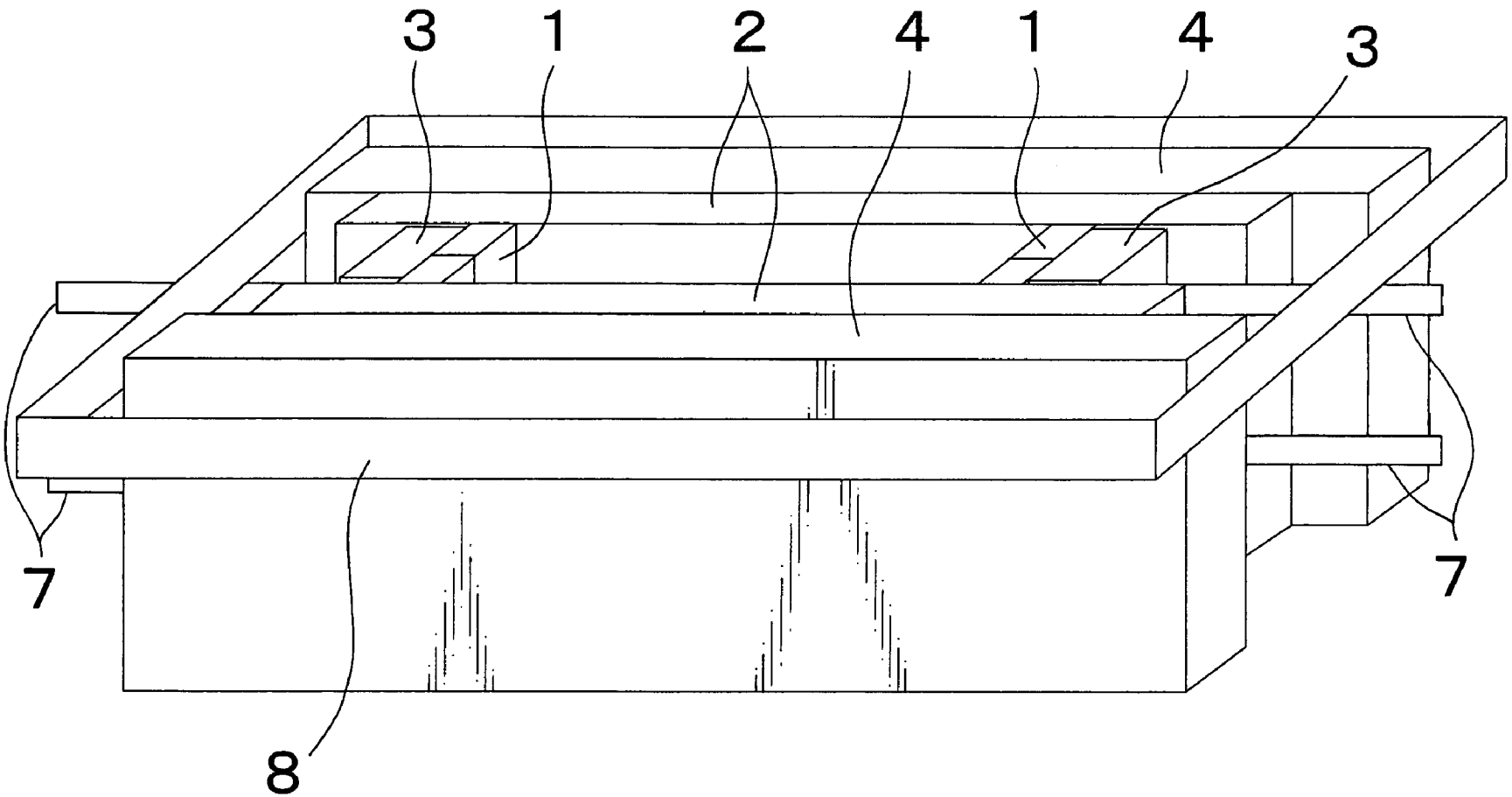
FIG. 1 is a perspective view schematically showing a mold for continuous casting according to the present invention.
Figure 2:
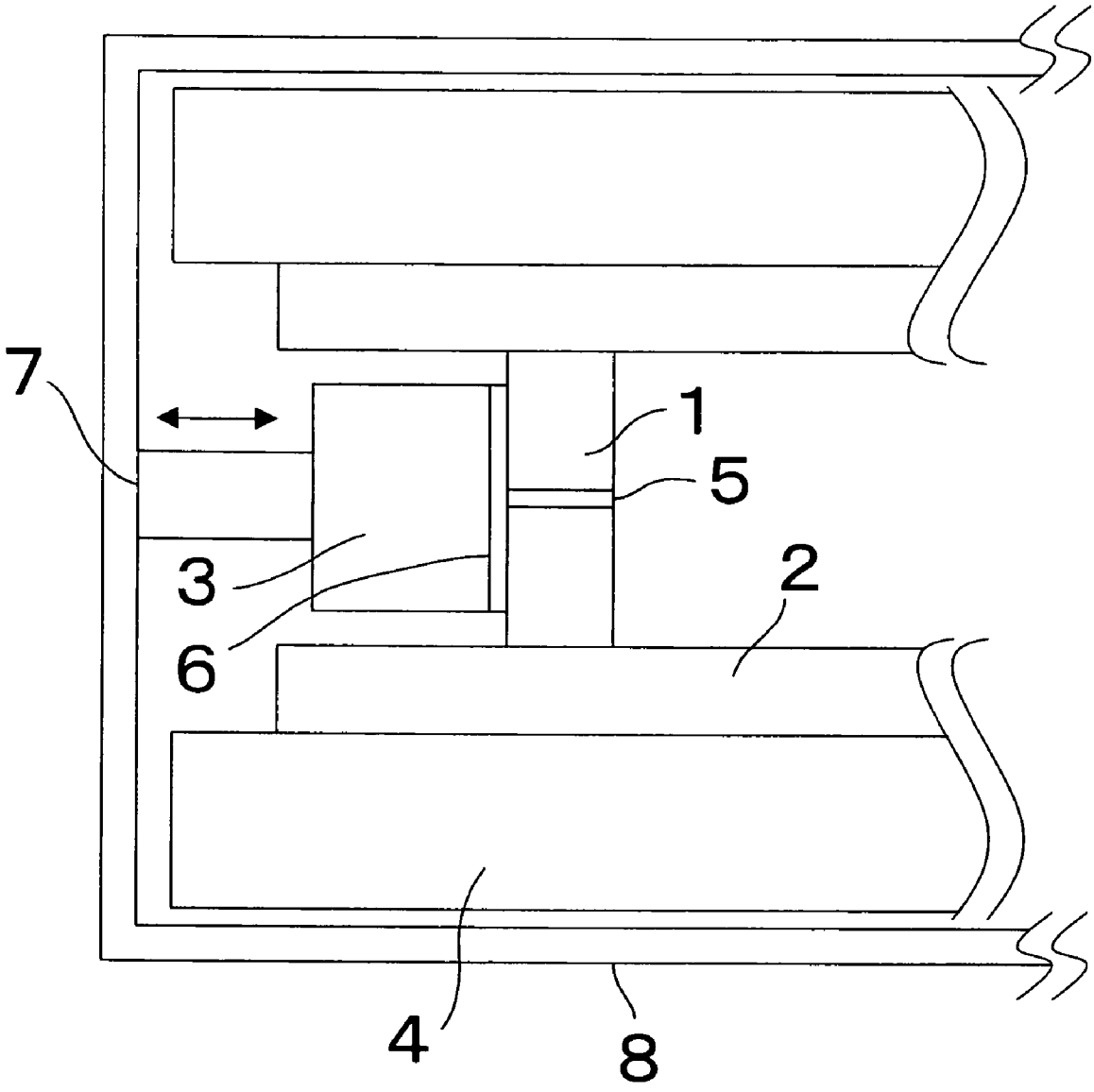
FIG. 2 is a horizontal sectional view schematically showing a mold for continuous casting according to the present invention.

FIG. 1 is a perspective view schematically showing a concept of the fabrication of a mold for continuous casting according to the present invention and FIG. 2 is a horizontal sectional view schematically showing a mold for continuous casting according to the present invention. In FIGS. 1 and 2, in the mold for continuous casting according to the present invention, the wall of the mold is composed of a pair of opposed first cooling copper plates 1 and a pair of opposed second cooling copper plates 2 that interpose the first cooling copper plates 1 in between. The first cooling copper plates 1 are at the narrower sides of the mold and are movable between the second cooling copper plates. The second cooling copper plates 2 are at the wider sides of the mold and are fixed. A magnet coil 8 that imposes electromagnetic force in the direction perpendicular to the inner wall of a mold on molten metal in the vicinity of the meniscus of the molten metal in the mold is disposed around the circumference of the mold.

Further, the first cooling copper plates 1 and the second cooling copper plates 2 have metallic contact with each other and are electrically connected. This is because, if the contact portions between the first cooling copper plates and the second cooling copper plates are electrically insulated on some occasions and electrically connected on other occasions, the induced current flowing in the copper plates fluctuates and thus the electromagnetic force imposed on molten steel becomes unstable. As a result, the shape of the meniscus also becomes unstable and there is the possibility of the danger of breakout or the like. Consequently, the contact portions have to be either electrically insulated completely or electrically connected completely during casting. When it is attempted to electrically insulate the contact portions, the insulation film can hardly avoid the damage by friction or the intrusion of foreign materials that occurs in accordance with the movement of the first cooling copper plates and the first back plates and thus the attempted electrical insulation is unstable. In contrast, the contact area between the first cooling copper plates and the second cooling copper plates is large enough to electrically connect one with the other and therefore casting is stabilized in the case of the electrical connection rather than the electrical insulation.

Further, on the outer side of the cooling copper plates, namely on the side opposite the faces of the cooling copper plates which touch molten steel, a pair of first back plates 3, each of which is combined with and supports each of the first cooling copper plates 1, and a pair of second back plates 4, each of which is combined with and supports each of the second cooling copper plates 2, are disposed. Here, it is preferable to divide each of the first cooling copper plates 1 into two parts so as to be separated in the plate width direction and insert an insulator 5 between the divided two parts.

This is because, by so doing, induced current flowing in the cooling copper plates decreases and thus the attenuation of a magnetic field also decreases. When cooling copper plates are divided, the second cooling copper plates may also be divided. However, when the second cooling copper plates (on wider side) are divided, a casting is likely to generate cracks due to uneven solidification and mold restraint and also the rigidity of the mold deteriorates. In this light, the following explanation is based on the examples of the cases where the first cooling copper plates on the narrower side of a mold are divided but the same explanation is still applicable to the cases where the second cooling copper plates on the wider side of a mold are divided.

The first cooling copper plates 1 may be divided along the direction parallel to the casting direction. However, by so doing, the temperature at the divided portions at which insulators are placed rises and the solidification of a slab becomes insufficient at the portions. In order to avoid the problem, it is effective to divide the first cooling copper plates in the direction inclining from the casting direction and it is preferable that the angle θ between the direction along which the first cooling copper plates are divided and the casting direction satisfies the following expression:

$$\theta > \tan^{-1} A.$$

Here, A is a figure obtained by dividing the thickness of an insulator by 100 mm. The reason is that the unevenness of solidification in the range of about 100 mm in length in the casting direction most affects the cracking or the like of a casting in the vicinity of a meniscus. In other words, the reason is that it is preferable to eliminate the portions that continue to touch insulators during the time when a casting passes through the range of 100 mm in length in the casting direction, namely, to eliminate the portions of a casting that pass through only insulators while the casting travels the distance of 100 mm in the casting direction.

Further, the upper limit of the angle between the direction along which the first cooling copper plates are divided and the casting direction is determined by the intervals of bolts in the plate width direction, the bolts being used for joining the first cooling copper plates 1 and the first back plates 3. In the case of inclining the dividing direction within the restriction caused by the intervals of the bolts for a conventional mold, the maximum angle is 5°.

Figures 7A, 7B, 7C, 7D:
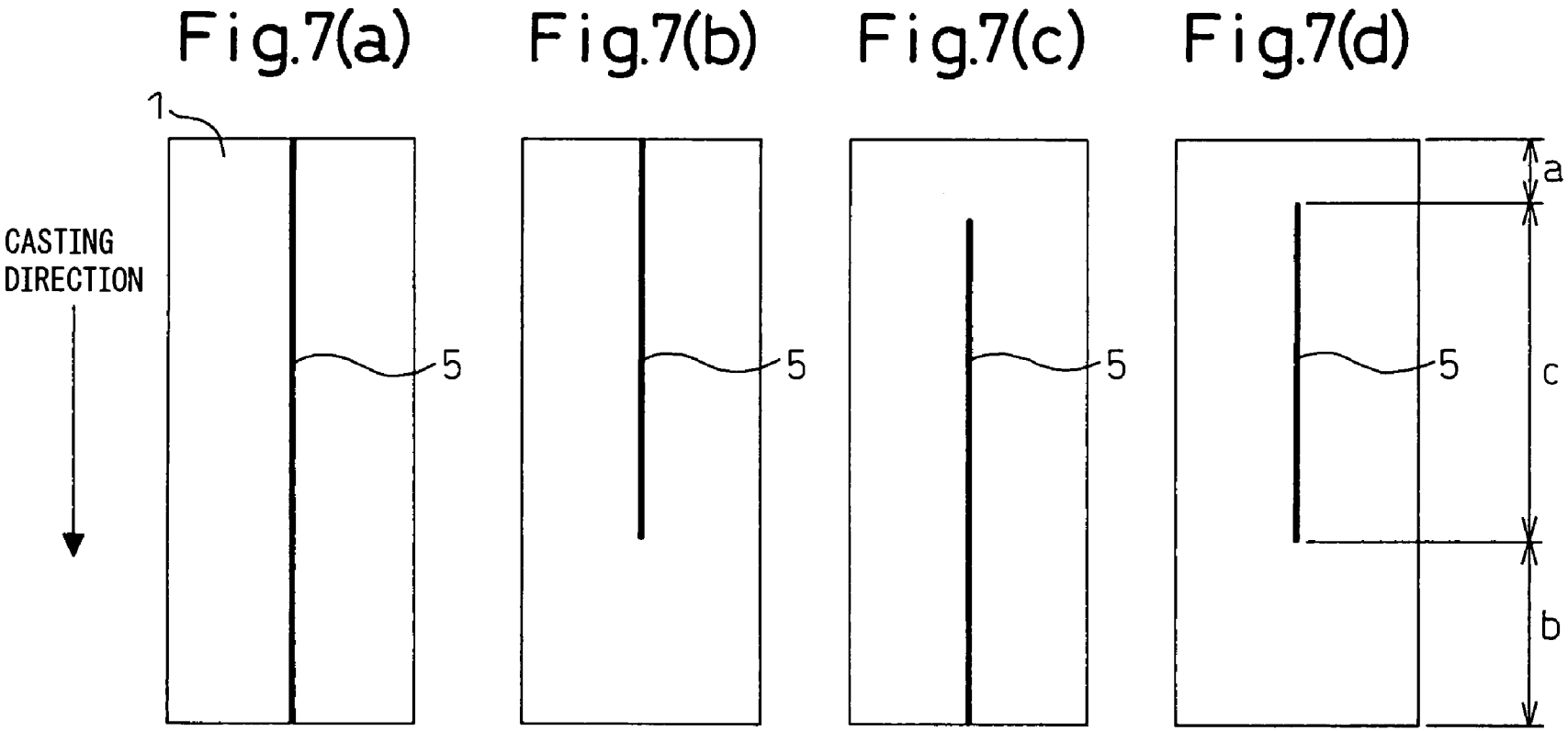
FIG. 7(*a*) is a schematic illustration showing an example of the way in which a cooling copper plate is divided from the top end to the bottom end thereof along the casting direction.

FIGS. 7(*a*) to 7(*d*) are schematic illustrations showing the examples of the way in which a cooling copper plate is divided. FIG. 7(*a*) shows an example of the way in which a cooling copper plate is divided from the top end to the bottom end thereof along the casting direction, FIG. 7(*b*) an example of the way in which a cooling copper plate is divided from the top end to an intermediate portion thereof along the casting direction while the bottom end portion b thereof remains undivided, FIG. 7(*c*) an example of the way in which a cooling copper plate is divided from an intermediate portion to the bottom end thereof along the casting direction while the top end portion a thereof remains undivided, and FIG. 7(*d*) an example of the way in which a cooling copper plate is divided at an intermediate portion thereof along the casting direction while the top end a and bottom end b portions thereof remain undivided.

When a cooling copper plate is divided, it is preferable to completely divide the cooling copper plate from the top end to the bottom end thereof along the casting direction (FIG. 7(*a*)), but it is still possible to restrain the attenuation of electromagnetic force even in the case where only a part of a cooling copper plate is divided along the casting direction. In such cases, as shown in FIG. 7, there are the methods of: dividing a cooling copper plate from the top end to an intermediate portion thereof with the remaining bottom portion of the length b undivided (FIG. (*b*)); dividing a cooling copper plate from an intermediate portion to the bottom end thereof with the remaining top portion of the length a undivided (FIG. 7(*c*)); and dividing a cooling copper plate at an intermediate portion of the length c thereof with the remaining top portion of the length a and bottom portion of the length b undivided (FIG. 7(*d*)). It is possible to restrain the attenuation of a magnetic field as long as cooling copper plates are divided in the range of ±200 mm from the position where a magnet coil is placed. When a cooling copper plate is completely divided from the top end to the bottom end thereof, the rigidity of the mold deteriorates. However, it is possible to enhance the strength against the thermal deformation of a cooling copper plate by not dividing but leaving a portion as a monolithic construction. In addition, an advantage of the method of leaving the bottom end portion as a monolithic construction (FIG. 7(*b*)) is that, though the bottom end portion of a cooling copper plate wears by the contact with a casting during use for casting, by not dividing it at the portion, it becomes possible to avoid the formation of difference in level even when the wear is uneven. The method of not dividing but leaving the top end portion of a cooling copper plate as a monolithic construction (FIG. 7(*c*)) has the advantage of making it difficult for powder supplied on molten steel to intrude into the divided gap during casting. The method of leaving the top and bottom end portions as monolithic constructions (FIG. 7(*d*)) can enjoy both the above advantages.

In order to further restrain the attenuation of a magnetic field, it is preferable to insulate the first back plates 3 of the narrower side from the first cooling copper plates 1 with insulators 6 interpolated and, moreover, to insulate the bolt joints of the first back plates 3 and the first cooling copper plates 1 with insulative sleeves and insulative washers.

This is because, when the first cooling copper plates 1 and the first back plates 3 are combined with each other without being electrically insulated, induced current flowing in the cooling copper plates flows also in the back plates and there arises the possibility of the attenuation of a magnetic field.

It is preferable that the second cooling copper plates 2 of the wider side are made of a copper alloy, to which Cr, Zr and Al are added, having an excellent permeability of electromagnetic force and a small electric conductivity. Further, it is possible to enhance the permeability of electromagnetic force by reducing the thickness of the copper alloy of a cooling copper plate. However, it is necessary to keep the thickness of a cooling copper plate not less than 10 mm in order to fasten a back plate thereto with bolts. On the other hand, the upper limit of the thickness of the copper alloy of a cooling copper plate is preferably not more than 60 mm in view of a machining cost.

When the first cooling copper plates 1 of the narrower side are divided, the thickness thereof may be heavier than that of the second cooling copper plates 2 of the wider side in consideration of the cooling configuration and the rigidity of a mold. Here, even though the thickness of the first cooling copper plates 1 is increased, the attenuation of a magnetic field is small.

It is preferable that the first back plates 3 do not touch or are electrically insulated from the second cooling copper plates 2 and the second back plates 4 by inserting insulators in between.

When the first cooling copper plates 1 and the first back plates 3 move while being interposed between the second cooling copper plates 2, it is a general practice that only the first cooling copper plates touch the second cooling copper plates and in many cases the first back plates 3 do not touch the cooling copper plates 2 and back plates 4 of the wider side.

Rigidity of the second back plates 4 must be taken into consideration in order to restrain the deformation of cooling copper plates during casting and, in the case of a mold used for casting a slab 1 m or more in the wider side width for example, a preferable thickness of the second back plates 4 is 40 mm or more. On the other hand, if the thickness of the second back plates 4 exceeds 70 mm, the loss of a magnetic field caused by the current induced in the back plates increases. Therefore, it is preferable that the thickness thereof is not more than 70 mm.

There are some cases where the second back plates 4 are fixed to each other with clamp bolts in order to interpose the first cooling copper plates 1 and the first back plates 3 between a pair of the second sets each of which is composed of a second cooling copper plate 2 and a second back plate 4. In those cases, it is preferable to electrically insulate the clamp bolts in order to prevent induced current from flowing among black plates through the clamp bolts. That is, it is preferable that the second back plates 4 don't touch each other or, in the case where they are fixed with bolts or the like, they are electrically insulated from each other. In the same way, it is preferable that the first back plates 3 each of which is combined with the relevant first cooling copper plate 1 do not touch or are electrically insulated from the second cooling copper plates 2 and the second back plates 4 each of which is combined with the relevant second cooling copper plate 2.

Here, in the present invention, an insulator means a substance that has the function of electrical insulation. Materials suitable as insulators are an electrically insulative ceramic plate, a ceramic formed by coating, an oxidic ceramic, a mica plate, a ceramic fiber compact, a resin and the like.

Suitable coating methods are thermal spraying, CVD (Chemical Vapor Deposition), ion plating, sputtering and the like. As an oxidic ceramic, an alumina-, a zirconia-, a yttria-, or a magnesia-type ceramic is suitable. In the case of a resin, nylon, Teflon (a registered trademark), polyimide or the like is suitable.

Such insulators are inserted in the gap between the divided parts of a cooling copper plate and the gap between a divided part of the cooling copper plate and the back plate combined therewith. When a first back plate touches a second cooling copper plate, it is preferable to insert an insulator in between. However, there is a possibility that the insulator exfoliates due to the movement of the first back plate, and therefore it is preferable to design so that a first back plate may not touch a second cooling copper plate.

It is preferable that the thickness of an insulator inserted in the gap between the divided parts of a cooling copper plate is 10 μm or more in order to secure insulation and 1 mm or less in order to restrain the intrusion of molten steel at the early stage of casting. When coating is applied as an insulator to the gap between the divided parts of a cooling copper plate, the coating of the insulator is applied to either or both of the opposing faces of the divided parts of the cooling copper plate and further, when the total thickness of the coating is still not more than 1 mm, it is then possible to insert another insulator in the gap.

It is preferable that the thickness of an insulator inserted between a divided part of a cooling copper plate and a back plate combined therewith is 10 μm or more in order to secure insulation in the same way as the case of the insulator inserted in the gap between the divided parts of a cooling copper plate. In order to attach the divided parts of a cooling copper plate to a back plate so as to form a flat face and avoid difference in level, it is desirable that an insulator inserted in between does not deform largely at the time of assembly and, when an insulator is elastic and deforms largely, it is preferable to use a thinner insulator.

Further, a magnetic field varies in accordance with the difference in the properties of a material used as a back plate and, when a back plate is made of nonmagnetic stainless steel, the attenuation of the electromagnetic field in a mold is small. That is, when it is desired to restrain the attenuation of a magnetic field in a mold, it is preferable that a back plate is made of nonmagnetic stainless steel and, for example, SUS304-, SUS316-, and SUS310-type stainless steels are suitable.

In contrast, when a first back plate 3 is made of copper or copper alloy having a high electric conductivity, the electromagnetic field in a mold attenuates. This is because, when an electrically conductive metal is placed in the interior of a coil, induced current flows there abundantly in the direction of compensating the magnetic field. In this light, when it is desired to attenuate the magnetic field in the vicinity of a first cooling copper plate of the narrower side, it is preferable that the first back plate 3 is made of copper or copper alloy having a high electric conductivity.

Further, it is also possible to attenuate an electromagnetic field by increasing the thickness of the first back plates 3.

Furthermore, cylinders 7 used for changing the width of a casting are installed outside the first back plates 3.

It is desirable to adopt such types of cylinders as to be able to freely vary the width on-line during casting and it is preferable to adopt a structure having a hydraulic type control mechanism. In addition, in order to have a mechanism that can freely vary the incline of the narrower side, it is preferable to attach two cylinders along the direction of casting.

Around the circumference of a mold configured as stated above, a coil 8, used for conducting alternating current that imposes an alternating magnetic field on molten metal in a mold during casting, is installed.

EXAMPLES

Figure 3:
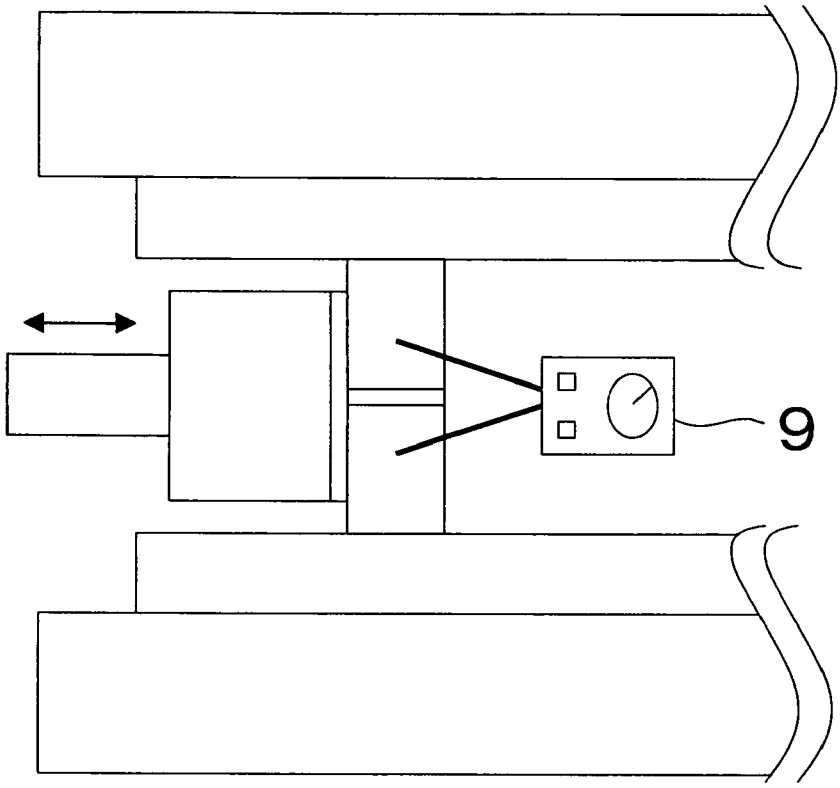
FIG. 3 is a view showing a means of measuring the state of insulation of a mold for continuous casting according to the present invention.

A mold having the second cooling copper plates 1,200 mm in width and the first cooling copper plates 250 mm in width, each of the first cooling copper plates being divided into two parts along the center line of the plate width, was made and the deterioration of insulation caused by casting was measured. With the aim of clarifying the state of insulation, the mold was not equipped with an alternating current coil and the electric resistance between the two divided parts of a cooling copper plate was measured after casting by using a circuit tester 9 connected to a first cooling copper plate as shown in FIG. 3.

Insulation of the gap between the divided parts of a cooling copper plate was measured under various conditions including the insertion of an insulator, the application of an insulation film by thermal spraying on either or both of the divided faces of a first cooling copper plate, and further both the insertion and thermal spraying of insulators. The thickness of the insulator was adjusted to 0.3 mm in all cases. The insulator was applied by the insertion of a ceramic plate, a mica plate, a ceramic fiber compact or Teflon (a registered trademark) or the thermal spraying of an alumina-, a zirconia-, a yttria- or a magnesia-type ceramic, individually or occasionally in combination.

Figure 4:
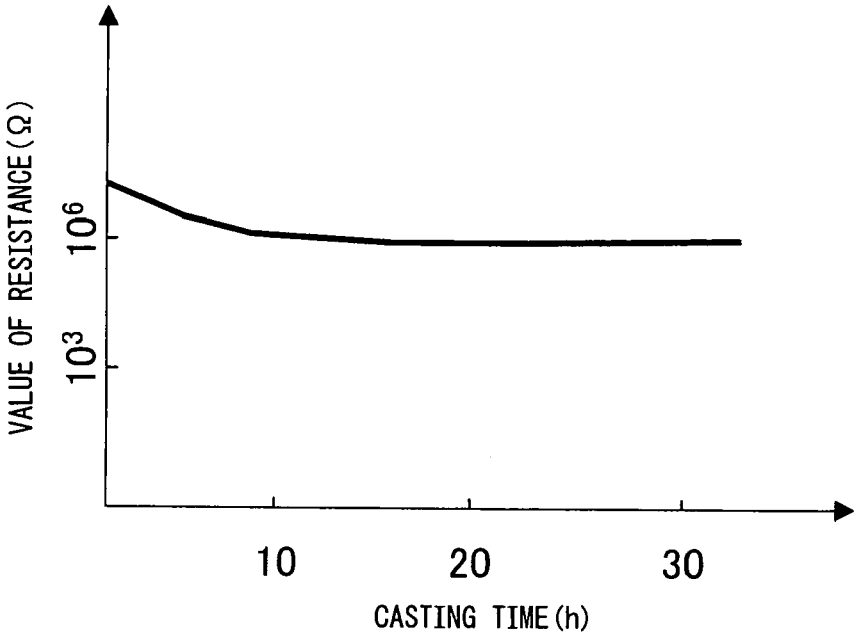
FIG. 4 is a graph showing the relationship between a casting time and an insulation resistance value in a mold for continuous casting according to the present invention.

FIG. 4 shows an example of the change of a resistance value with the passage of time. In FIG. 4, the horizontal axis represents the accumulation of casting time. The insulation resistance decreased somewhat at an early stage of casting when the accumulated casting time was still short, and thereafter it became constant and was about 1 MΩ. No difference was seen in the trend of the decrease of insulation resistance among various conditions including the kind and combination of various insulators and the insulation resistance after the casting of 20 hours was about 1 MΩ.

Figure 6:
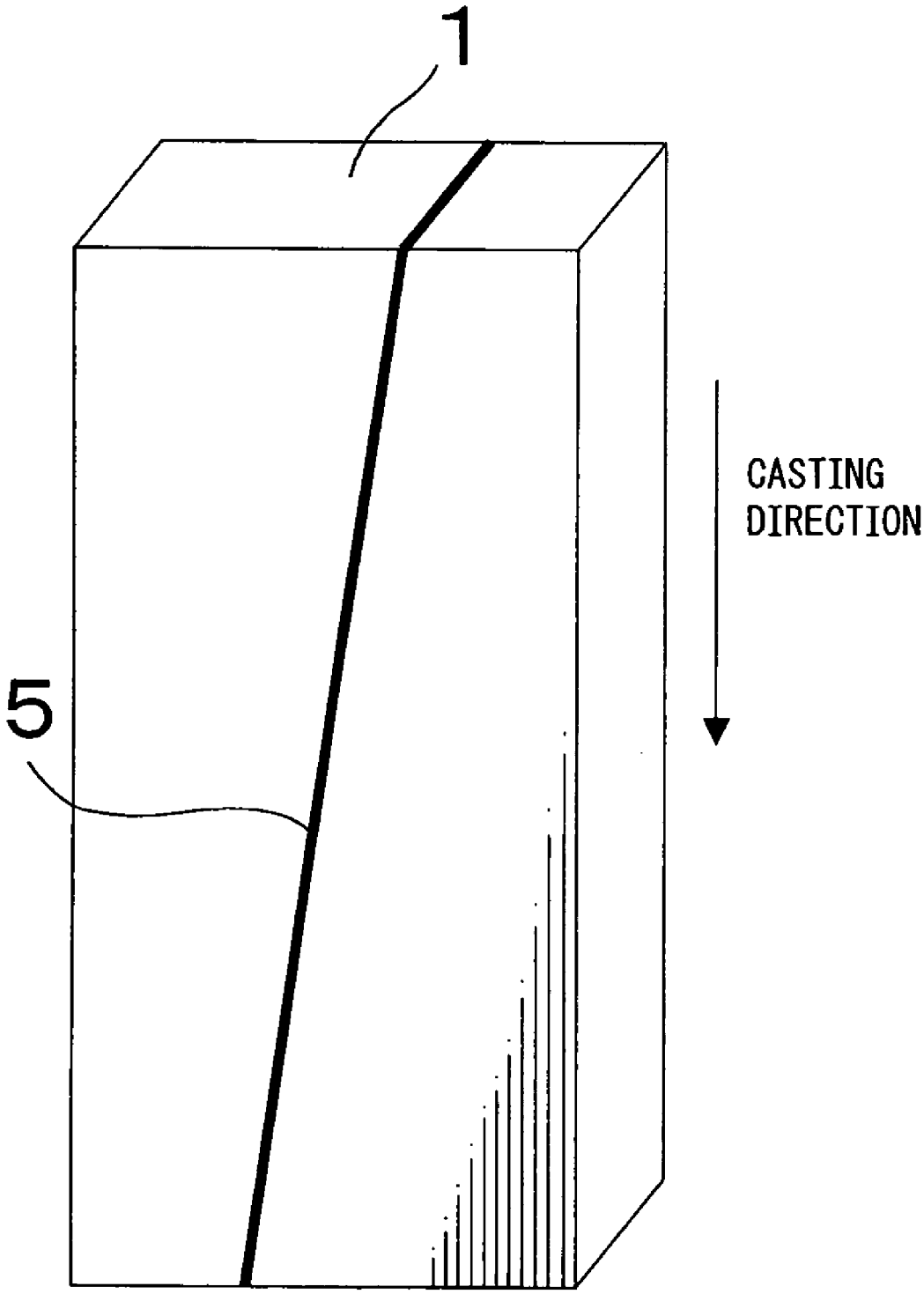
FIG. 6 is a schematic illustration showing a first cooling copper plate that is divided along a direction unparallel to the casting direction in a mold for continuous casting according to the present invention.

Further, a mold equipped with cooling copper plates 1 divided along the casting direction and a mold equipped with cooling copper plates 1 divided at an angle of 1° to the casting direction as shown in FIG. 6 were made and similar casting tests were carried out while the thickness of the insulator was changed.

Figure 5:
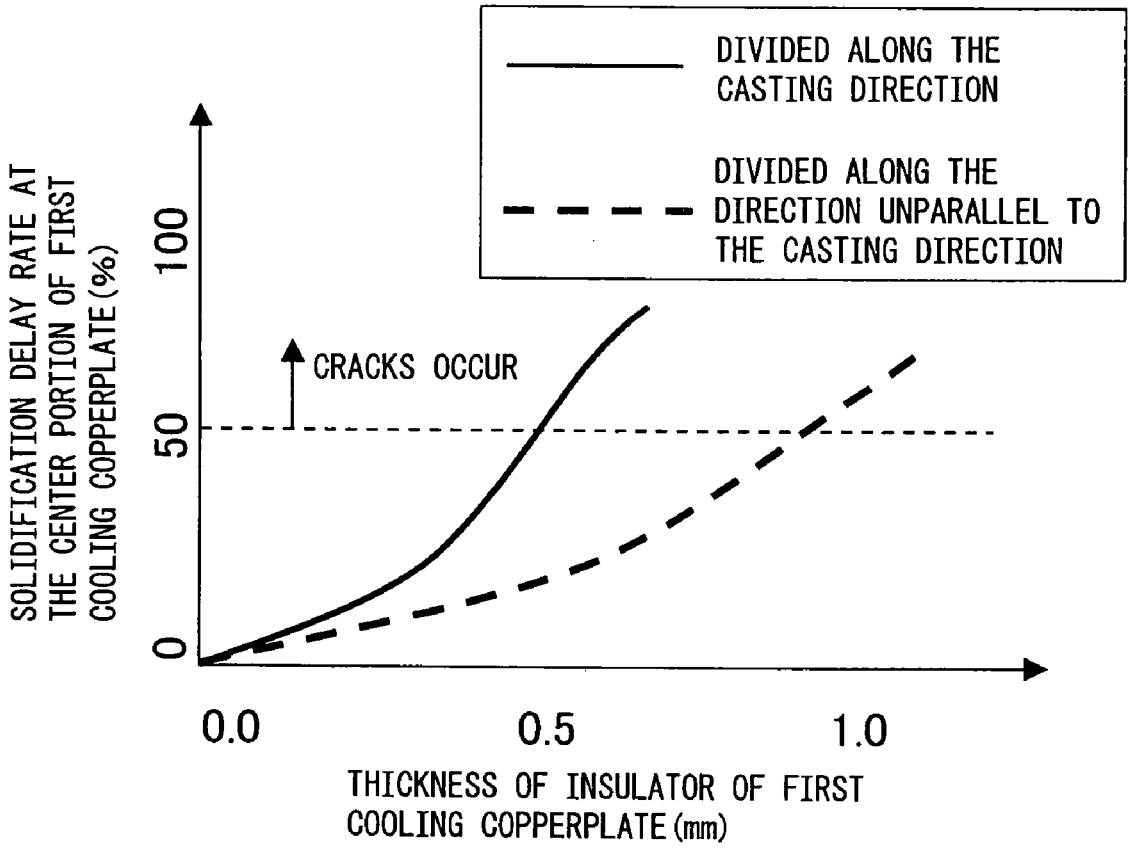
FIG. 5 is a graph showing the relationship between the thickness of an insulator inserted between adjacent divided parts of a first cooling copper plate and a solidification delay rate at the center portion of the first cooling copper plate in a mold for continuous casting according to the present invention.

The results are shown in FIG. 5. Here, a solidification delay rate at the center portion of a first cooling copper plate is a value obtained by: dividing the difference between the thickness of a shell at the bottom end in the center of the width of the first cooling copper plate and the thickness of the shell at portions other than the center of the width but in the vicinity of the center by the latter thickness; and expressing the quotient in terms of percentage. It was shown that, as a solidification delay rate in the center of the width of the first cooling copper plate increased, the degree of solidification delay also increased. When the thickness of an insulator increased and exceeded 1 mm, the degree of solidification delay became conspicuous and cracks appeared. It was understood from the result that a preferable thickness of an insulator was 1 mm or less. Further, in the case of dividing the cooling copper plates not along the casting direction but at an angle of 1° to the casting direction, the solidification delay was improved even though the thickness of the insulator was 2 mm or so.

Figure 8:
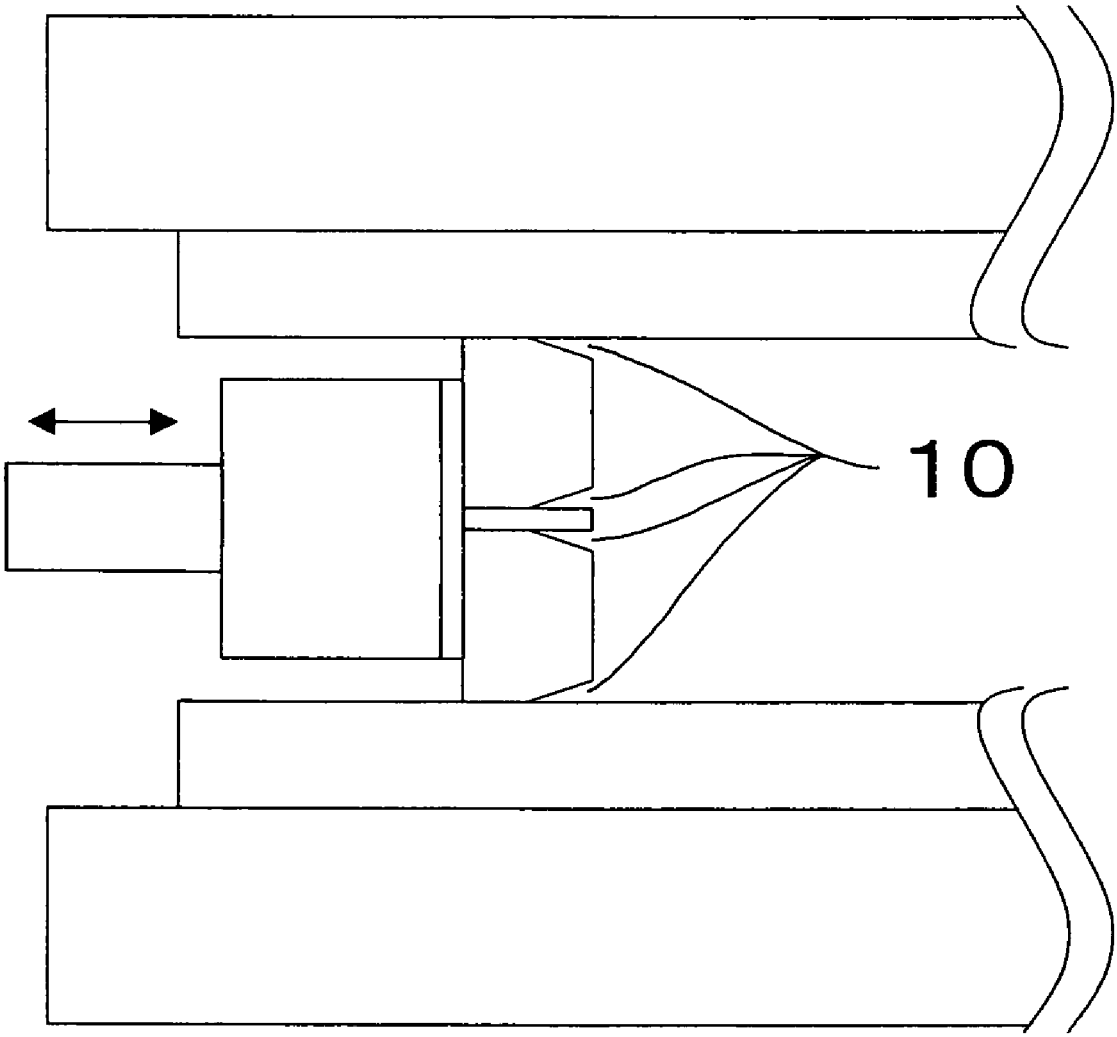
FIG. 8 is a schematic illustration showing the gap between adjacent divided parts of a first cooling copper plate, the gap being caused by the deformation of the first cooling copper plate, in a mold for continuous casting according to the present invention.
Figure 9:
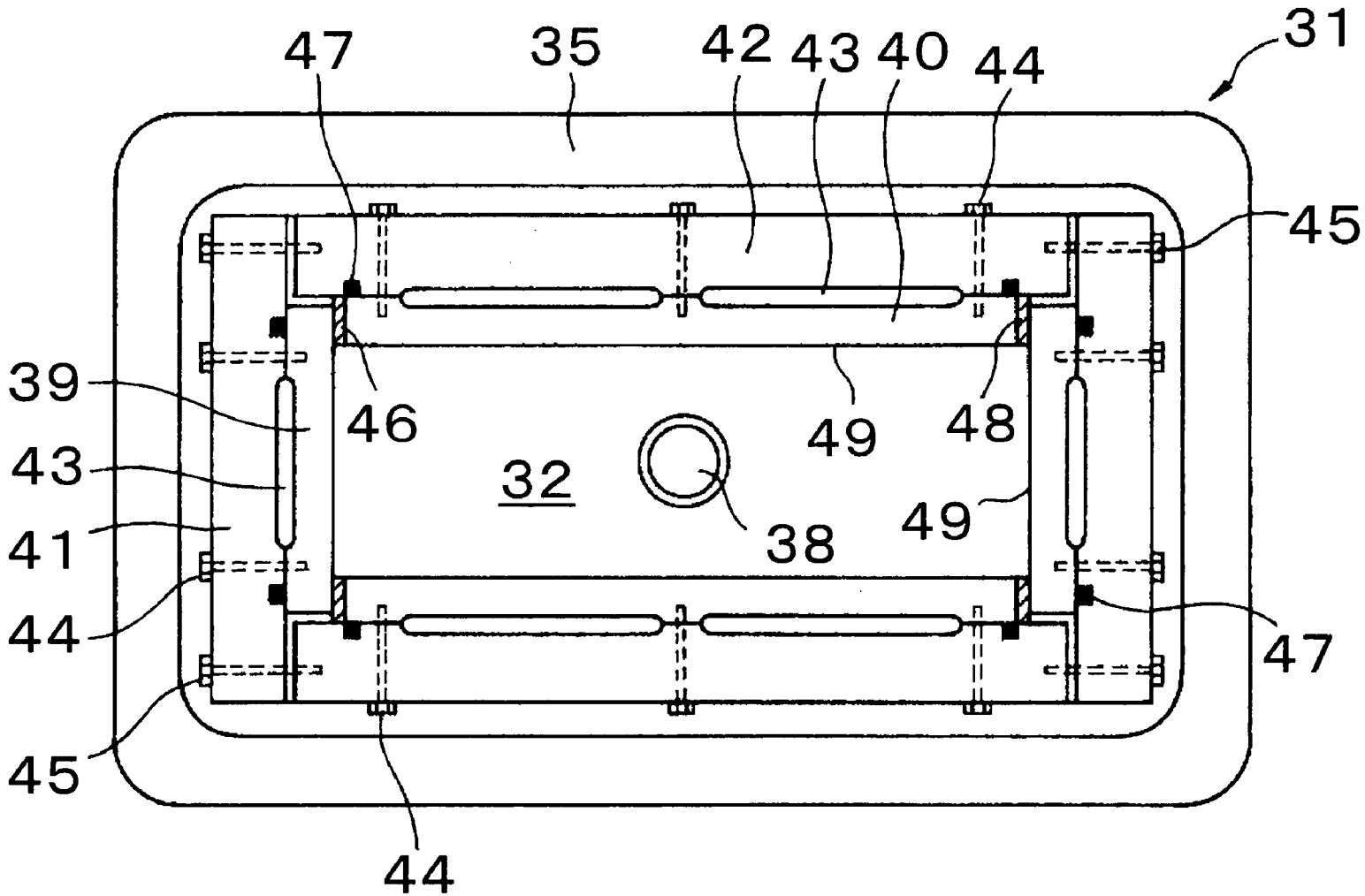
FIG. 9 is a horizontal sectional view sowing a conventional mold for continuous casting having insulators at the portions where the mold is divided.
Figure 10:
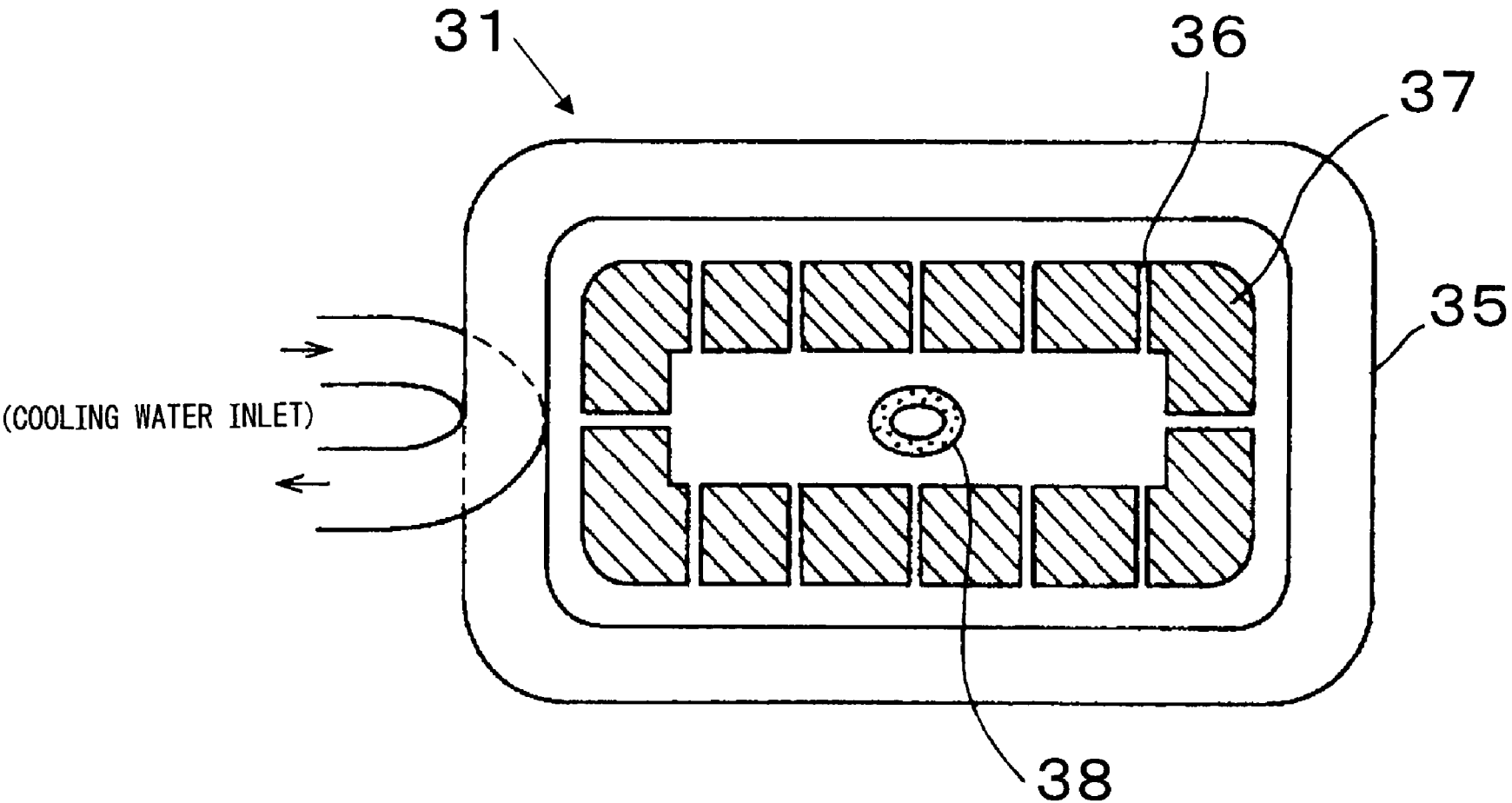
FIG. 10 is another horizontal sectional view showing a conventional mold for continuous casting having slits at the upper portions thereof.
Figure 11:
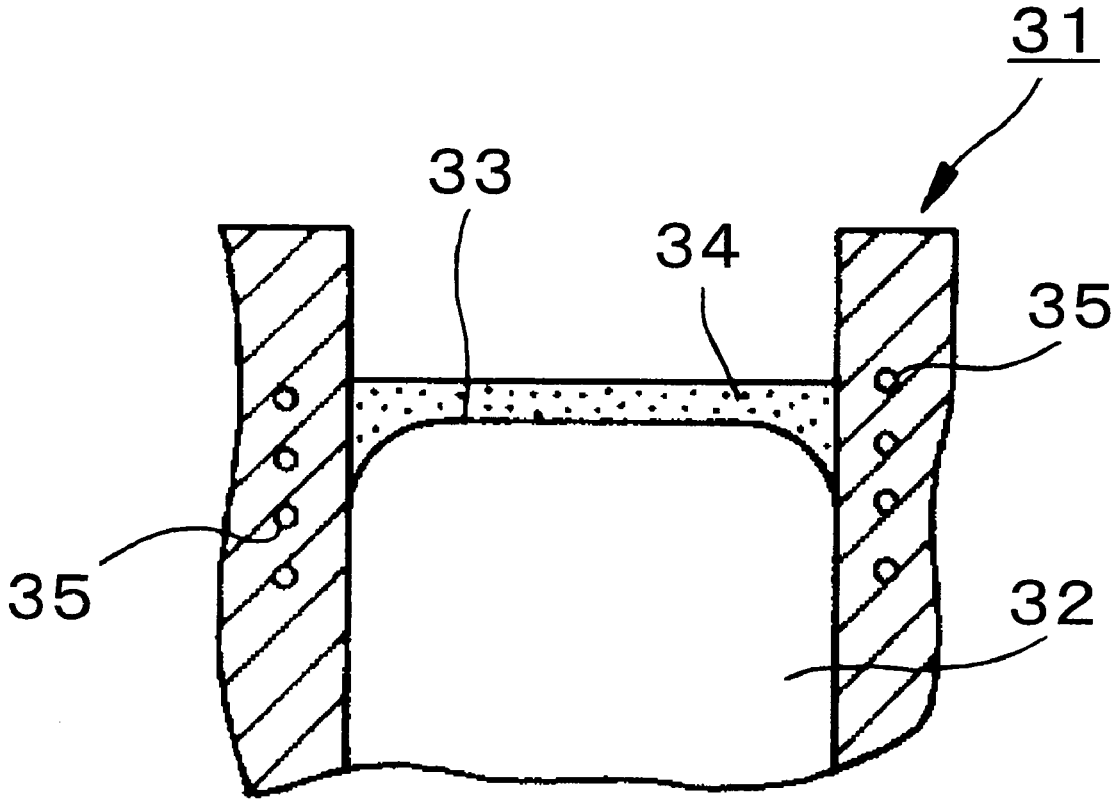
FIG. 11 is a schematic illustration showing a continuous casting technology of imposing electromagnetic force.

Furthermore, the deformation of the divided parts of cooling copper plates was also measured and the change of the gap with the passage of time between the mating faces, namely the mating faces of the divided parts of a cooling copper plate and the mating faces of a first cooling copper plate and a second cooling copper plate, was investigated. It was found that, when the thermal expansion of first cooling copper plates was completely constrained during casting by cramping the first cooling copper plates with second cooling copper plates, an opening deformation 10 appeared as shown in FIG. 8. In the case of a generally adopted mold for a slab wherein the first cooling copper plates were constrained with clamp bolts having a spring mechanism and being installed at the wider side of the mold, the plastic deformation of the cooling copper plates was mitigated and the opening deformation of the mating faces scarcely appeared after casting.

In addition, casting tests were also carried out by using the aforementioned mold to which an alternating current coil was attached. Instability of the meniscus was not seen during the application of electric current and, also, breakout did not occur.

INDUSTRIAL APPLICABILITY

A mold for continuous casting according to the present invention, when molten metal is continuously cast while electromagnetic force is imposed thereon, makes it possible to prevent the insulation of the mold from deteriorating even when the casting width of the mold is changed repeatedly, to secure the insulation of the mold stably when the mold is used for a long period, and thus produce castings of good quality for a long period of time.

The invention claimed is:

1. A mold for continuous casting, said mold for continuous casting: being equipped with a magnet coil that imposes electromagnetic force on molten metal in the direction perpendicular to the inner wall of said mold in the vicinity of the meniscus of said molten metal in said mold for continuous casting, a pair of the first sets each of which is formed by combining a first cooling copper plate with a first back plate and another pair of the second sets each of which is formed by combining a second cooling copper plate with a second back plate; and being configured so that a pair of said first sets each of which is composed of a first cooling copper plate and a first back plate are movably interposed between a pair of said second sets each of which is composed of a second cooling copper plate and a second back plate, and said first cooling copper plates of a pair of said first sets are interposed between said second cooling copper plates of a pair of said second sets in the state of not being electrically insulated from but being electrically connected with each other, characterized by: dividing either or both of said first cooling copper plates of a pair of said first sets and said second cooling copper plates of a pair of said second sets so that each of the relevant cooling copper plates is divided into two or more parts so as to be separated in the plate width direction; and making the adjacent divided parts touch each other in an electrically insulated manner.

2. A mold for continuous casting according to claim 1, characterized in that the back plate combined with each of said cooling copper plates, each of which is divided into two or more parts, does not touch or is electrically insulated from the relevant cooling copper plate divided into two or more parts.

3. A mold for continuous casting according to claim 1 or 2, characterized by dividing said relevant cooling copper plates along the direction parallel to the casting direction.

4. A mold for continuous casting according to claim 1 or 2, characterized by dividing said relevant cooling copper plates at an angle of 5° or less to the casting direction.

5. A mold for continuous casting according to claim 1 or 2, characterized by inserting an insulator 10 μm to 1 mm in thickness between adjacent two divided parts of each of said relevant cooling copper plates.

6. A mold for continuous casting according to claim 1 or 2, characterized by inserting an electrically insulative ceramic plate or an insulator comprising a ceramic, formed by coating, between two adjacent divided parts of each of said relevant cooling copper plates.

7. A mold for continuous casting according to claim 1 or 2, characterized by inserting an insulator comprising any one or more of an oxidic ceramic, a mica plate, a ceramic fiber compact and a resin between two adjacent divided parts of each of said relevant cooling copper plates.

8. A mold for continuous casting according to claim 2, characterized by inserting an electrically insulative ceramic plate or an insulator comprising a ceramic, formed by coating, between each of said divided cooling copper plates and the back plate combined therewith.

9. A mold for continuous casting according to claim 2, characterized by inserting an insulator comprising any one or more of an oxidic ceramic, a mica plate, a ceramic fiber compact and a resin between each of said divided cooling copper plates and the back plate combined therewith.

10. A mold for continuous casting according to claim 1 or 2, characterized in that said first back plates are made of any one of stainless steel, copper and a copper alloy.

11. A mold for continuous casting according to claim 1 or 2, characterized in that said first back plates of a pair of said first sets do not touch or are electrically insulated from said second cooling copper plates and said second back plates of a pair of said second sets.

12. A mold for continuous casting according to claim 1 or 2, characterized in that said second back plates of a pair of said second sets do not touch or are electrically insulated from each other.

13. A mold for continuous casting according to claim 1 or 2, characterized in that each of said cooling copper plates to be divided is not fully but partially divided so that only a part of the full length from the top end to the bottom end of said cooling copper plate in the casting direction may be divided.

* * * * *